US005624296A

United States Patent [19]

Weber-Unger

[11] Patent Number: 5,624,296

[45] Date of Patent: Apr. 29, 1997

[54] ITEM OF CLOTHING WITH HANDLING DEVICE FOR SEPARATING ELEMENTS

[75] Inventor: Georg Weber-Unger, Kufstein, Austria

[73] Assignee: Anita International Dr. Helbig GmbH. & Co. KG, Brannenburg, Germany

[21] Appl. No.: 432,286

[22] Filed: May 1, 1995

[30] Foreign Application Priority Data

May 6, 1994 [DE] Germany ..... 44 16 799.7

[51] Int. Cl.[6] ..... A41B 3/04; A41D 27/00

[52] U.S. Cl. ..... 450/36; 2/104; 2/101; 2/73

[58] Field of Search ..... 2/73, 67, 101, 2/247, 248, 249, 250, 251, 252, 21, 104, 105, 336, 340, 160, 162, 163, 170, 115; 450/36, 86, 88, 60, 1, 72, 73; 24/163 K, 165, 169, 182, 195, 602

[56] References Cited

U.S. PATENT DOCUMENTS

| | | | |
|---|---|---|---|
| 1,483,595 | 2/1924 | Read | 2/21 X |
| 2,455,788 | 12/1948 | Cascio | 450/72 |
| 2,613,355 | 10/1952 | Coleman | 2/104 X |
| 3,532,096 | 10/1970 | Seidl | 450/86 X |
| 3,930,271 | 1/1976 | Kahng | 2/21 X |
| 4,335,728 | 6/1982 | Fildan | 450/36 |
| 5,032,104 | 7/1991 | Rainville | 2/101 |

*Primary Examiner*—Jeanette E. Chapman
*Attorney, Agent, or Firm*—Mark P. Stone

[57] ABSTRACT

In order to facilitate the handling of items of clothing having an arrangement for connecting and separating two coupling elements (2, 5), a pocket (7) or bridge which serves to receive the tip of the thumb (8) or of a finger of the wearer is assigned to at least in each case one coupling element (5). With the aid of the thumb tip inserted into the pocket (7), the coupling elements (2, 5) can be easily separated and also connected again.

14 Claims, 2 Drawing Sheets

ITEM OF CLOTHING WITH HANDLING DEVICE FOR SEPARATING ELEMENTS

BACKGROUND OF THE INVENTION

The invention relates to an item of clothing, in particular a bra or swimsuit top, having at least one arrangement for connecting and separating two coupling elements which are each connected fixedly to parts of the item of clothing and having a handling aid which can be actuated by a thumb or finger being assigned to at least in each case one of the coupling elements.

A multitude of items of clothing having closures exhibiting preferably hooks and eyes are known, in particular in the form of bras and swimsuit tops. The coupling elements should be distinguished by simplicity, reasonable price and stability. In order, in the case of known items of clothing, to separate the respective coupling parts from one another, however, the use of two fingers is usually required, the two fingers having to grip, in the manner of pincers, at least one coupling element or that end of the part of the item of clothing, on which the coupling element is fastened, which is assigned to the coupling element. This type of handling is particularly awkward if the coupling elements are located in the back region of an item of clothing or else rest firmly against the body. In order, in cases of the last-mentioned type, to render unnecessary the action of engaging behind parts of the item of clothing which rest against the body and, furthermore, to facilitate the handling of the closures formed by the coupling elements for people who suffer from arthritis, U.S. Pat. No. 4,917,651 has proposed to assign a loop in each case to one of the coupling elements, it being possible for a finger to be inserted into said loop for closing and opening the closure. However, this known solution is not fully satisfactory either. A first reason for this consists in the fact that the loops, fitted in the manner of lugs on the item of clothing, noticeably detract from the appearance of said item of clothing. Added to this is the fact that the lug-like or tab-like design of the loops makes it considerably more difficult to insert a finger into the respective loop, and the increase in ease of handling sought after, in particular, for handicapped people is consequently not achieved to the desired extent.

SUMMARY OF THE INVENTION

The object of the invention, in the case of an item of clothing of the type considered, is to eliminate the outlined shortcomings, i.e. to improve further its handlability without detracting from its appearance. This object is achieved according to the invention in that the handling aid comprises a pocket or bridge which is fixed on the item of clothing and is designed as a stationary abutment for the end of a thumb or finger.

By using pocket-like or bridge-like abutments, the position of the insertion opening for the finger of the wearer is clearly established, whith the result that difficulties caused by a displacement of the handling aid can no longer occur.

The invention has proved particularly advantageous in conjunction with breast-feeding bras if in each case one coupling element connects two sections of a strap fixedly to one another, and in each case one coupling element is arranged at the tip of a fold-open cup.

BRIEF DESCRIPTION OF THE DRAWINGS

The invention is explained in more detail hereinbelow with reference to the accompanying drawing, in which.

DESCRIPTION OF THE BEST MODES FOR CARRYING OUT THE INVENTION

Figure 1:
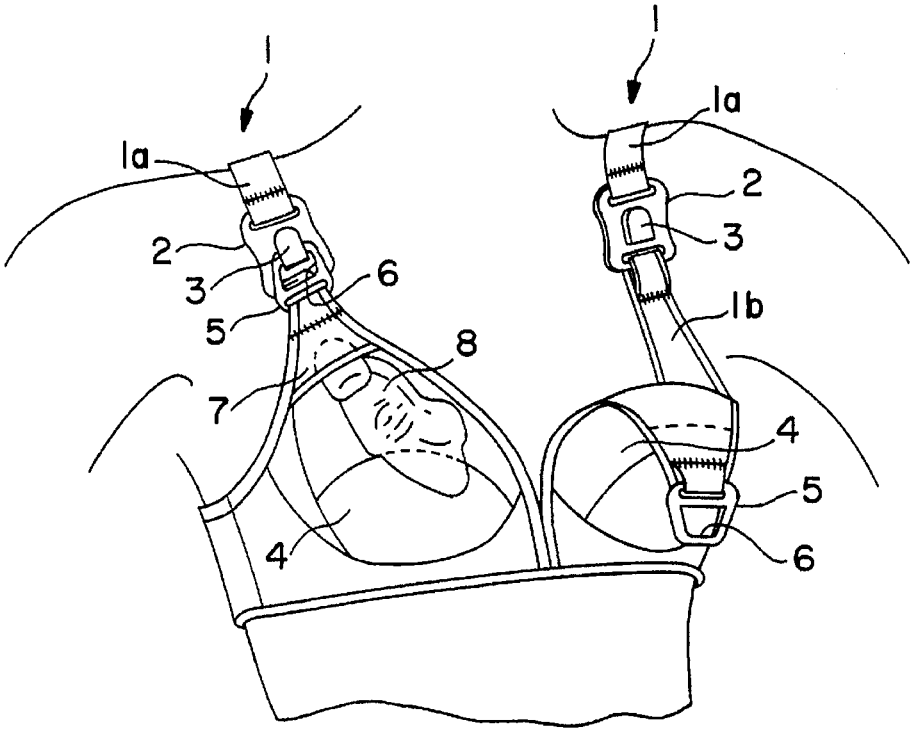
FIG. 1 shows the front view of a first breast-feeding bra.

The breast-feeding bra represented in FIG. 1 exhibits two continuous straps 1, of which each comprises two sections 1*a* and 1*b*, which—as can be seen in the right-hand part of FIG. 1—are fixedly connected to one another by in each case one coupling element 2. Coupling elements 5 arranged at the tip of the cup 4 of the bra can be connected to coupling elements 2, which exhibit a hook 3, by means of the eyes 6 which can be fitted into the hooks 3. On the outer side of the cup 4, pockets 7 are positioned proximate to the coupling elements 5, it being possible for the wearer of the bra to insert the tip of her thumb 8 or of a finger into said pockets in order to release the connection between the hook 3 and the eye 6. The "single-finger use" facilitates the handling of the bra to a considerable extent. The coupling elements 2 and 5 are particularly simple because each of them consists of one piece only.

Figure 2:
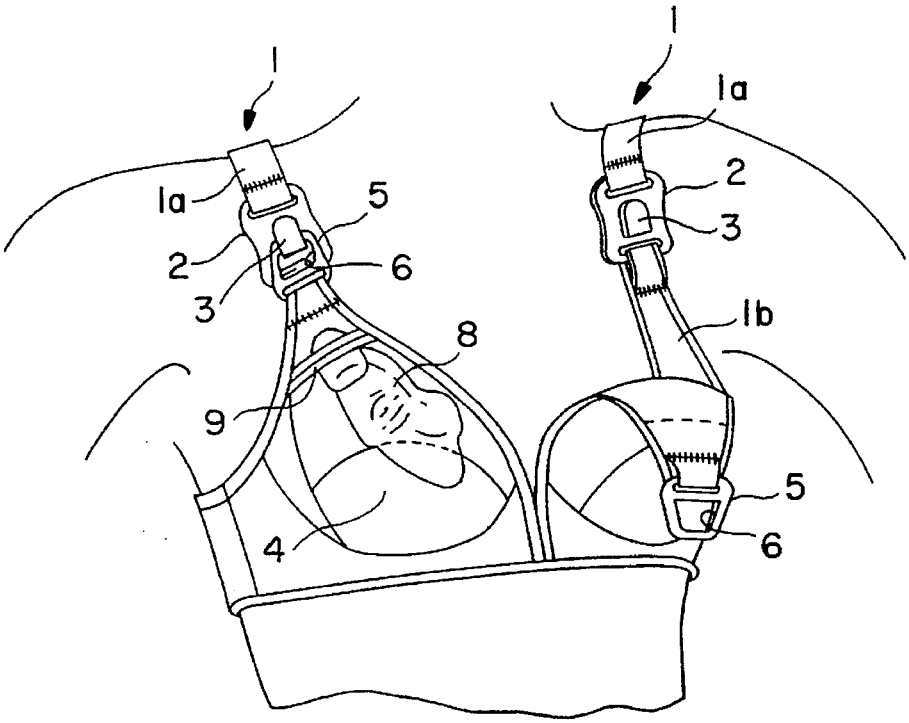
FIG. 2 shows the front view of a slightly modified second breast-feeding bra.

Instead of pockets 7, use may also be made of bridges 9 comprising cross-sewn strips of material, as is shown in FIG. 2.

Figure 3:
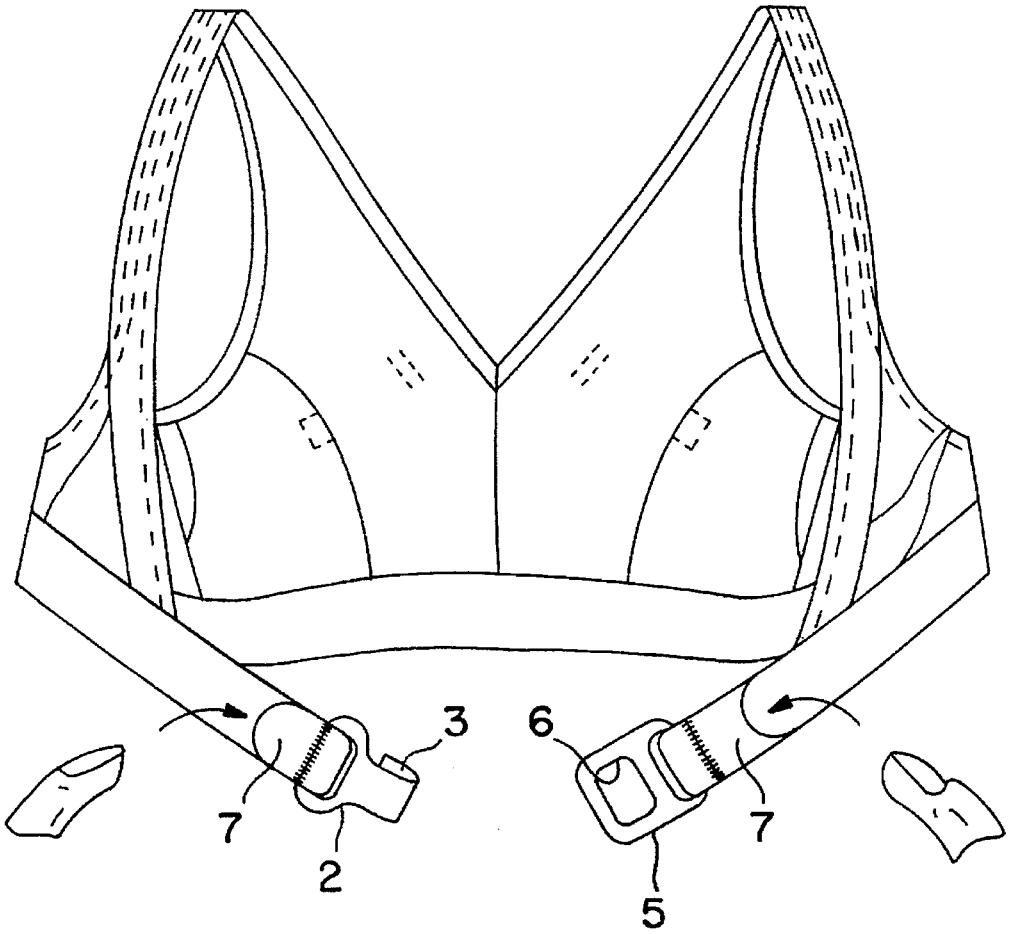
FIG. 3 shows the back view of a swimsuit top.

While, in case of the type represented in FIGS. 1 and 2, one can manage with in each case only one pocket 7 or one bridge 9 for each connection as a result of the positional fixing of the coupling element 2 by the sections 1*a* and 1*b* of the straps 1, in each case two pockets 7, of which each is assigned to a coupling element 2 or 5, is required for the convenient opening and closing of the back part of the swimsuit top represented in FIG. 3.

Instead of coupling elements provided with hooks and eyes, use may also be made, for example, of coupling elements designed as stud fasteners or touch-and-close fastener parts or zip closure parts.

I claim:

1. A nursing bra having at least one arrangement for connecting and separating first and second coupling elements, each of said first and said second coupling elements being fixedly connected to different parts of said nursing bra, and a handling aid adapted to be actuated by a thumb or finger positioned proximate to one of said first and second coupling elements for selectively connecting and separating said first and second coupling elements, said handling aid comprising a pocket (7) which is fixed on said nursing bra and comprises a stationary abutment for the end of said thumb or finger provided to actuate said handling aid.

2. The nursing bra as claimed in claim 1, said nursing bra comprising at least one strap having two sections (1*a* and 1*b*), said first coupling element (2) fixedly connecting said two sections to each other, said second coupling element being arranged proximate to the tip of a fold-open cup of said nursing bra.

3. The nursing bra as claimed in claim 2 wherein the first coupling element (2) connecting the two sections (1*a*, 1*b*) comprises a hook (3).

4. The nursing bra as claimed in claim 1, wherein said item of clothing includes a pair of rear body portions having ends connectable to each other by means of said first and second coupling elements attached to said ends, and said handling aid comprising said pocket (7) is positioned proximate to each of said first and second coupling elements.

5. The nursing bra as claimed in claim 1 wherein said first coupling element comprises an eye and said second coupling element comprises a hook, said hook having a prong fittingly receivable into said eye.

6. The nursing bra as claimed in claim 2 wherein said nursing bra includes a pair of rear body portions having ends connectable to each other by means of said first and second coupling elements attached to said ends, and said handling aid comprising said pocket (7) is positioned proximate to each of said first and second coupling elements.

7. The nursing bra as claimed in claim 2, wherein said first coupling element comprises an eye and said second coupling element comprises a hook, said hook having a prong fittingly receivable into said eye.

8. A nursing bra having at least one arrangement for connecting and separating first and second coupling elements, each of said first and said second coupling elements being fixedly connected to different parts of said nursing bra, and a handling aid adapted to be actuated by a thumb or finger positioned proximate to one of said first and second coupling elements for selectively connecting and separating said first and second coupling elements, said handling aid comprising a bridge (9) which is fixed on said nursing bra and comprises a stationary abutment for the end of said thumb or finger provided to actuate said handling aid.

9. The nursing bra as claimed in claim 8, said nursing bra comprising at least one strap having two sections (1*a* and 1*b*), said first coupling element (2) fixedly connecting said two sections to each other, said second coupling element being arranged proximate to the tip of a fold-open cup of said nursing bra.

10. The nursing bra as claimed in claim 9 wherein the first coupling element (2) connecting the two sections (1*a*, 1*b*) comprises a hook (3).

11. The nursing bra as claimed in claim 8, wherein said nursing bra includes a pair of rear body portions having ends connectable to each other by means of said first and said second coupling elements attached to said ends, and said handling aid comprising said bridge (9) is positioned proximate to each of said first and second coupling elements.

12. The nursing bra as claimed in claim 8, wherein said first coupling element comprises an eye and said second coupling element comprises a hook, said hook having a prong fittingly receivable into said eye.

13. The nursing bra as claimed in claim 10, wherein said nursing bra includes a pair of rear body portions having ends connectable to each other by means of said first and second coupling elements attached to said ends, and said handling aid comprising said pocket (7) is positioned proximate to each of said first and second coupling elements.

14. The nursing bra as claimed in claim 9, wherein said first coupling element comprises an eye and said second coupling element comprises a hook, said hook having a prong fittingly receivable into said eye.

* * * * *